US007530248B2

(12) United States Patent
Shimoda et al.

(10) Patent No.: US 7,530,248 B2
(45) Date of Patent: May 12, 2009

(54) PLUG FOR USE IN PIERCING MILL

(75) Inventors: Kazuhiro Shimoda, Osaka (JP); Tomio Yamakawa, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/155,657

(22) Filed: Jun. 6, 2008

(65) Prior Publication Data

US 2008/0314109 A1 Dec. 25, 2008

Related U.S. Application Data

(63) Continuation of application No. PCT/JP2006/324204, filed on Dec. 5, 2006.

(30) Foreign Application Priority Data

Dec. 7, 2005 (JP) ..... 2005-353665

(51) Int. Cl.
*B21B 19/04* (2006.01)

(52) U.S. Cl. ..... 72/97

(58) Field of Classification Search ..... 72/96, 72/97, 208, 209, 365.2, 366.2, 370.01, 370.06, 72/478

See application file for complete search history.

(56) References Cited

U.S. PATENT DOCUMENTS

| | | | | |
|---|---|---|---|---|
| 2,017,388 | A * | 10/1935 | Bannister | 72/97 |
| 2,803,154 | A * | 8/1957 | McClay | 72/97 |
| 6,988,387 | B2 * | 1/2006 | Nakaike et al. | 72/97 |
| 7,293,443 | B2 * | 11/2007 | Hayashi | 72/97 |
| 2005/0210944 | A1 | 9/2005 | Nakaike et al. | |

FOREIGN PATENT DOCUMENTS

| | | | |
|---|---|---|---|
| JP | 57-050233 | | 3/1982 |
| JP | 2-224805 | * | 9/1990 |
| JP | 08-294712 | | 11/1996 |
| JP | 09-029310 | | 2/1997 |
| JP | 9-300007 | * | 11/1997 |
| JP | 2003-001305 | | 1/2003 |
| WO | 2004/052569 A1 | | 6/2004 |

* cited by examiner

*Primary Examiner*—Edward Tolan
(74) *Attorney, Agent, or Firm*—Clark & Brody

(57) ABSTRACT

A plug has a tip end portion, a taper portion, and a middle portion. The surface of the tip end portion is a spherical surface whose radius of curvature is R1 and length is L1 that is shorter than R1. The outer diameter of the taper portion on the front end side is D1, and the outer diameter on the back end side is D2 that is larger than D1, and the length is L2. The plug satisfies Expression (1), Expression (2) if 0<L1/R1<0.5 and Expression (3) if 0.5≦L1/R1<1. The curve of the spherical surface of the tip end portion is gentler than that of the semi-spherical surface, and the diameter of a hole formed in a billet by the tip end portion is larger than that in the case of the semi-spherical surface. Therefore, the taper portion does not contact with the billet $$0.5D1<L1+L2\leqq 2.5D1 \quad (1)$$

$$1.0<D2/D1\leqq 1.4 \quad (2)$$

$$1.0<D2/D1<1.8-0.8L1/R1 \quad (3).$$

3 Claims, 11 Drawing Sheets

PLUG FOR USE IN PIERCING MILL

This application is a continuation of International Patent Application No. PCT/JP2006/324204, filed Dec. 5, 2006. This PCT application was not in English as published under PCT Article 21(2).

TECHNICAL FIELD

The present invention relates to a plug, and more specifically, to a plug for use in a piercing mill that pierces a billet to form a seamless pipe or tube.

BACKGROUND ART

A plug used in a piercing mill pierces a heated billet (round billet) to form a hollow pipe or tube. As shown in FIG. 11, a plug 100 is provided between a pair of inclined rolls 150 each inclined with respect to a pass line PL. The plug 100 is pressed into a billet 50 rotated by the inclined rolls 150 in the circumferential direction, and then the piercing mill pierces and rolls the billet 50 along its central axis to form the billet into a hollow pipe or tube 51.

The plug 100 is in contact with the billet 50 in the piercing and rolling process and subjected to heat and strong pressure from the billet 50, and therefore its surface is likely to be eroded. As disclosed by JP 9-29310 A, the eroded plug is re-grinded in the axial direction for reuse. More specifically, as shown in FIG. 12, when the plug 100 has erosion 110 at a surface SF1, the plug 100 is re-grinded in the axial direction until the erosion 110 at the surface is removed. At the time, a plug surface SF2 after the re-grinding has the same shape as that of the original surface SF1. In this way, the plug can be reused because the surface SF2 of the plug has substantially the same shape as that of the original surface though the overall plug length is reduced. The overall length of the plug is however reduced every time the plug is re-grinded, and therefore the number of re-grinding is limited. Therefore, although the plug can be reused, the plug has a shorter useful life if it is frequently eroded.

A plug having a shape that allows erosion to be reduced is disclosed by JP 57-50233 A and WO 2004/052569 pamphlet. As shown in FIG. 13, the plug 200 disclosed by the documents includes a semi-spherical tip end portion 201, a columnar portion 202, and a middle portion 203 sequentially from the front end. When a billet 50 is pierced using the plug 200, a gap IS is formed between the billet 50 pierced by the tip end portion 201 and the surface of the columnar portion 202. In this way, the columnar portion 202 is not in contact with the billet 50, less heat is transmitted from the billet to the plug 200, and the gap IS allows heat stored in the plug 200 to be dissipated. Therefore, the plug 200 is less likely to be eroded as compared to a plug 100 having a conventional shape.

The plug 200 is however not suited for reuse by re-grinding. As shown in FIG. 14, if erosion 210 about as deep as the erosion 110 in FIG. 12 is generated at the columnar portion 202, a re-grinding allowance Lc necessary for returning the columnar portion 202 into the original shape is excessively greater than that of the plug 100. This is because the outer diameter of the columnar portion 202 is fixed, and the plug must be re-grinded for a length almost equal to the length of the erosion 210 to remove the erosion 210, or the columnar portion 202 cannot be returned to the original shape. Therefore, the overall length of the plug 200 after such re-grinding is too short for reuse.

In order to reduce the re-grinding allowance Lc for the plug 200, the outer diameter of the columnar portion 202 may be increased gradually from the front end side to the back end side of the plug so that the portion has a tapered shape. However, in the tapered shape, the gap IS is not formed between the portion and the billet in the piercing process, so that the billet and the tapered portion contact with each other and erosion is more easily caused.

SUMMARY OF THE INVENTION

It is an object of the invention to provide a plug that can used with reduced erosion and reused with a reduced re-grinding allowance.

The inventors considered that in a plug having a tip end portion like the above described plug 200, as the curve of the spherical surface of the tip end portion became gentler, the diameter of the hole formed in the billet by the tip end portion became greater.

In the plug in FIG. 1A, the surface shape of the tip end portion 10 is semi-spherical. In other words, the radius of curvature R1 of the tip end portion 10 is equal to the length L1 of the tip end portion 10. In this case, force acting to expand the hole H0 formed in a billet 30 by the tip end portion 10 is small. Therefore, the diameter $D_{H0}$ of the hole H0 is small and the gap IS0 between the surface of the hole H0 in the billet 30 and the surface of the columnar portion 16 is small.

Meanwhile, in the plug in FIG. 1B, the curve of the spherical surface of the tip end portion 10 is gentler than that of the semi-spherical surface. More specifically, the radius of curvature R1 is greater than the length L1. In this case, force acting to expand the hole H0 formed in the billet 30 by the tip end portion 10 is greater than that in FIG. 1A. Therefore, the diameter $D_{H0}$ of the hole H0 is greater than that in FIG. 1A, and the gap IS1 between the surface of the hole H0 and the surface of the columnar portion 16 is greater than the gap IS0.

Therefore, as denoted by the dotted line in FIG. 1B, when the radius of curvature R1 is larger than the length L1 and the curve of the spherical surface of the tip end portion 10 is gentler, a gap IS2 can be formed between the surface of the hole H0 and the surface of the taper portion 11 while the surface of the hole H0 is not in contact with the surface of the taper portion 11 if the columnar portion 16 is replaced by the taper portion 11 having a tapered shape whose outer diameter D1 on the front end side is smaller than the outer diameter D2 on the back end side. In this way, heat can be dissipated into the gap IS2 from the taper portion 11 and the erosion can be reduced. The taper portion 11 has the tapered shape and therefore if erosion occurs, the re-cutting allowance can be reduced as compared to the columnar portion 16 whose outer diameter is fixed as D1, and the plug is suitable for reuse.

The inventors prepared various plugs having tip end portions 10 in different spherical shapes, and examined the relation between the shapes of the tip end portions 10 and the taper portions 11 of the plugs that pierced without erosion. More specifically, various kinds of plugs having different lengths L1 and radii of curvature R1 for the tip end portions 10, and different outer diameters D2 and D1 for the taper portions 11 were prepared. The inventors pierced and rolled the billet 30 using each of the plugs, and examined the number of billets that were successfully pierced and rolled before any erosion occurred at the tip end portion 10 or the taper portion 11.

The result of examination is given in FIG. 2. In FIG. 2, the abscissa represents L1/R1. As the curve of the spherical surface of the tip end portion 10 becomes gentler, L1/R1 becomes smaller. If L1/R1=1.0 is established, the tip end portion 10 has a semi-spherical surface. The ordinate in FIG.

2 represents D2/D1. If the length of the taper portion 11 is fixed, the taper angle of the taper portion 11 increases as D2/D1 increases.

In FIG. 2, the mark "x" indicates that the number of the billets 30 that were successfully pierced and rolled before any erosion occurred (hereinafter referred to as "the rolled number") was zero. More specifically, in this example, it is indicated that erosion occurred after the end of the rolling of the first billet 30. In FIG. 2, the mark "Δ" indicates that the rolled number was one, the mark "○" indicates that the rolled number was two, and the mark "◎" indicates that the rolled number was at least three. It was determined that the erosion was reduced if the rolled number was two or more.

Referring to FIG. 2, as the L1/R2 decreased, the maximum value of D2/D1 that allowed the rolled number to be two or more increased. It was considered that as the curve of the spherical surface of the tip end portion became gentler, the diameter $D_{H0}$ of the hole H0 increased, and therefore although D2/D1 was large, the gap IS was formed between the billet 30 and the taper portion 11, which reduces erosion.

When L1/R1 was less than 0.5, however, the maximum value of D2/D1 that allowed the rolled number to be two or more was substantially fixed at 1.4 though L1/R1 further decreased. This is probably because the diameter $D_{H0}$ of the hole H0 did not increase and was kept almost fixed however smaller L1/R1 became. The billet 30 in the piercing process is subjected to force acting to expand the hole H0 by the tip end portion 10 of the plug, but is also subjected to force acting to reduce the size of the hole H0 by the inclined rolls. Therefore, it is considered that when L1/R1 was less than 0.5, the effect of the force from the inclined rolls causes the expansion of the hole H0 to converge.

Based on the findings described above, the inventors have completed the following invention.

The plug according to the invention is used in a piercing mill. The plug includes a tip end portion, a taper portion, and a middle portion sequentially in the direction from the front end to the back end of the plug. The surface of the tip end portion has a convex spherical surface in the axial direction of the plug, the radius of curvature is R1, and the length of the tip end portion is L1 that is shorter than R1. The surface of the taper portion is formed continuously with the surface of the tip end portion, the outer diameter of the taper portion on the front end side is D1, the outer diameter of the taper portion on the back end side is D2 that is larger than D1, and the length of the taper portion is L2. The surface of the middle portion is formed continuously with the surface of the taper portion, and the outer diameter of the middle portion gradually increases from the front end to the back end of the plug. The plug satisfies Expression (1), Expression (2) if 0<L1/R1<0.5, and Expression (3) if 0.5≦L1/R1<1.

$$0.5D1<L1+L2\leqq 2.5D1 \quad (1)$$

$$1.0<D2/D1\leqq 1.4 \quad (2)$$

$$1.0<D2/D1<1.8-0.8L1/R1 \quad (3)$$

In the plug according to the invention, the radius of curvature R1 of the tip end portion is larger than the length L1 of the tip end portion. In this way, the curve of the spherical surface of the tip end portion becomes gentler, and therefore the diameter of the hole to be formed in the billet can be larger than that in the case of using the semi-spherical tip end portion. Therefore, if the taper portion satisfies Expression (2) or (3), the taper portion is not in contact with the billet despite its tapered shape, and a gap is formed between the billet and the taper portion. In this way, the plug according to the invention prevents erosion if the plug has a tapered shape, and the tapered shape allows the plug to be reused with a reduced re-grinding allowance.

The part of the tip end portion adjacent to the taper portion preferably has a corner radius.

In this way, the surface of the tip end portion of the plug and the surface of the taper portion are more smoothly continued. Therefore, the adjacent portion to the tip end portion and the taper portion can be prevented from bearing any excessive load during piercing operation, and the adjacent portion can be prevented from being eroded.

The plug according to the invention is used in a piercing mill. The plug includes a taper portion and a middle portion sequentially in the direction from the front end to the back end of the plug. The taper portion on the front end side forms a plane parallel to a cross section of the plug. The diameter of the taper portion on the front end side is D1, the outer diameter of the taper portion on the back end side is D2 that is larger than D1, and the length of the taper portion is L2. The surface of the middle portion is formed continuously with the surface of the taper portion, and the outer diameter of the middle portion gradually increases from the front end to the back end of the plug. The plug satisfies the following Expressions (2) and (4):

$$1.0<D2/D1\leqq 1.4 \quad (2)$$

$$0.5D1<L2\leqq 2.5D1 \quad (4)$$

The tip end of the plug according to the invention forms a plane parallel to a cross section not a curved surface. Therefore, force acting to expand the hole formed in the billet is greater than that in the case of the semi-spherical tip end portion, and therefore the diameter of the hole in the billet can be larger. Since the diameter of the hole can be larger, the billet and the plug are not in contact with each other despite the tapered shape of the taper portion if the taper portion satisfies Expressions (2) and (4). Therefore, the plug according to the invention can prevent erosion despite its tapered shape. In addition, the re-grinding allowance can be reduced because of the tapered shape, and the plug can be reused after re-grinding.

DETAILED DESCRIPTION OF THE PREFERRED EMBODIMENTS

Figure 1A:
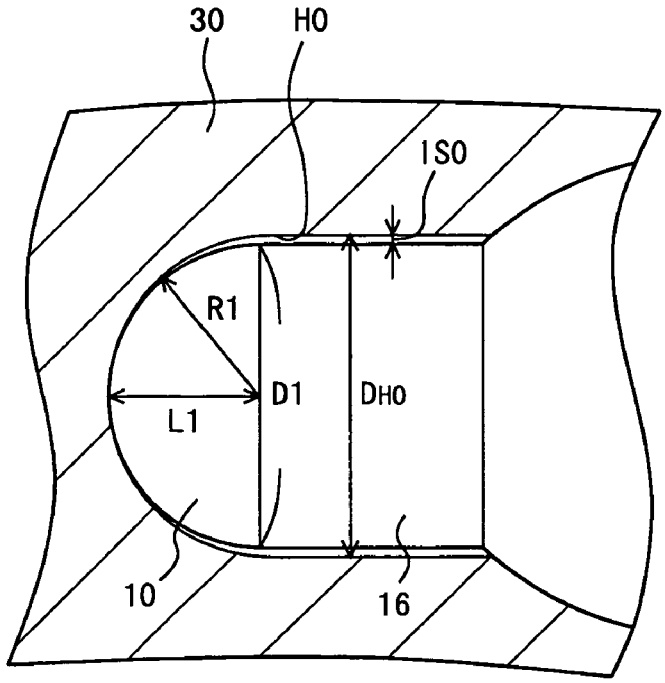
FIG. 1A is a view for use in illustrating the effect of the surface shape of the tip end portion of a plug upon the gap formed between a billet in the piercing and rolling process.

Now, embodiments of the invention will be described in detail in conjunction with the accompanying drawings, in which the same or corresponding portions are denoted by the same reference characters and the same description will not be repeated.

Shape of Plug

Figure 3:
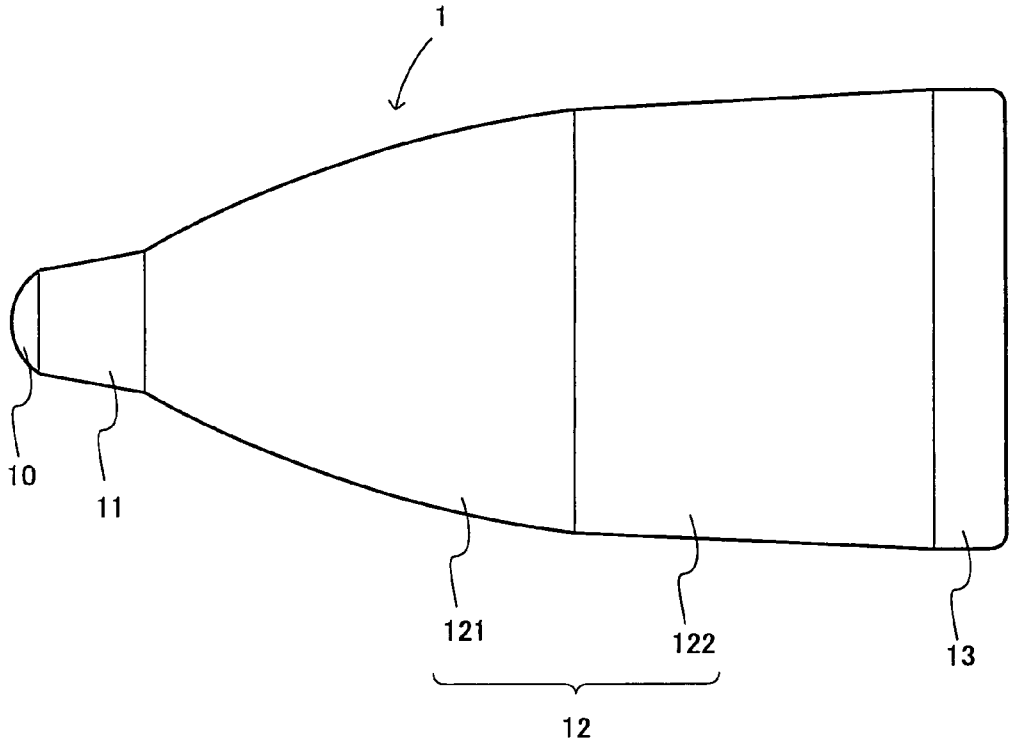
FIG. 3 is a side view of a plug according to an embodiment of the invention.
Figure 4:
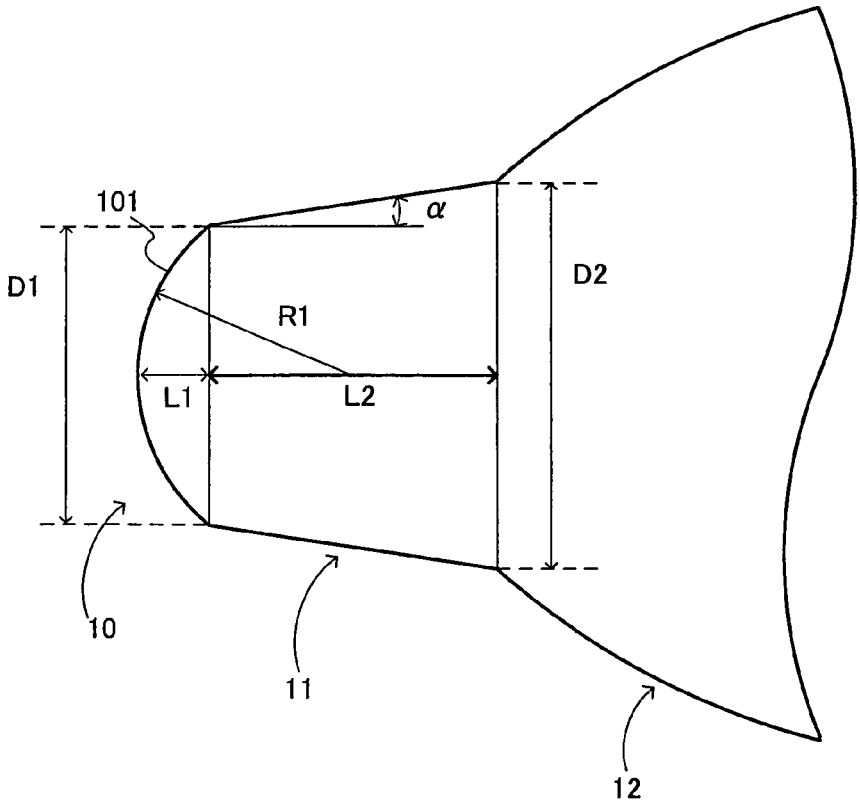
FIG. 4 is an enlarged view of the tip end portion and the taper portion shown in FIG. 3.

Referring to FIGS. 3 and 4, a plug 1 according to an embodiment of the invention includes a tip end portion 10, a taper portion 11, a middle portion 12, and a relief portion 13 sequentially from the front end to the back end. These elements all have a circular cross section and their surfaces are formed continuously with one another.

The tip end portion 10 is inserted into the center of an end surface of a billet (round billet) in the piercing and rolling process and serves to form a hole H0 in the direction of the central axis of the billet. The surface of the tip end portion 10 has a convex spherical surface 101 in the axial direction. The radius of curvature R1 of the spherical surface 101 is larger than the length L1 of the tip end portion 10. More specifically, the curve of the spherical surface 101 is gentler than the curve of a semi-spherical surface. Therefore, the tip end portion 10 can form a hole H0 having a larger diameter $D_{H0}$ in the billet than a conventional tip end portion having a semi-spherical shape. The tip end portion 10 enlarges the diameter $D_{H0}$, and therefore a gap IS can be formed between the billet and the taper portion 11.

As the radius of curvature R1 increases, the curve of the spherical surface 101 becomes gentler, and the surface area of the spherical surface 101 is reduced. The tip end portion 10 is in contact with the billet and receives heat from it, and if the surface area of the spherical surface 101 is reduced, the quantity of heat received from the billet is reduced as well. Since the spherical surface 101 has a smaller surface area than that of the semi-spherical surface, incoming heat from the billet can be reduced and the erosion can be reduced.

The taper portion 11 dissipates heat stored in the plug 1 into the gap IS between the billet and the taper portion 11 and serves to reduce erosion at the plug 1. The taper portion 11 can reduce the re-grinding allowance because of its tapered shape, and therefore the plug 1 can be reused.

The surface of the taper portion 11 is formed continuously with the surface of the tip end portion 10. The outer diameter of the taper portion 11 gradually increases from the front end to the back end of the plug 1 and is D1 at the front end side and D2 larger than D1 at the back end side.

The middle portion 12 serves to form the billet (hollow pipe or tube) having the hole H0 made by the tip end portion 10 into a desired shape. More specifically, the middle portion 12 contacts with the hollow pipe or tube and expands the inner diameter of the hollow pipe or tube, and the hollow pipe or tube is rolled between the middle portion 12 and the inclined rolls, so that the hollow pipe or tube is formed to have a desired thickness. The surface of the middle portion 12 is formed continuously with the surface of the taper portion 11, and the outer diameter of the middle portion 12 gradually increases from the front end to the back end of the plug 1.

The middle portion 12 includes a work portion 121 and a reeling portion 122 sequentially from the front end side of the plug 1. The work portion 121 has a circular surface of revolution and serves to expand the inner diameter of the hollow pipe or tube during piercing and rolling. The reeling portion 122 has a tapered shape and serves to make the inner diameter of the hollow pipe or tube into a desired thickness.

The relief portion 13 serves to prevent the inner surface of the hollow pipe or tube from being flawed. The outer diameter of the relief portion 13 is fixed or gradually decreases in the direction from the front end to the back end of the plug 1. Therefore, the relief portion 13 does not contact with the inner surface of the hollow pipe or tube in the piercing and rolling process, and the inner surface of the hollow-pipe or tube can be prevented from being flawed.

Shapes of Tip End Portion and Taper Portion

As described above, the plug 1 can prevent erosion by the function of the gap IS formed between the billet and the taper portion 11 in the piercing and rolling process and can reduce the re-grinding allowance because of the tapered shape of the taper portion 11. In order to make the most of the effect, the plug 1 satisfies the following Expression (1) and Expression (2) or (3):

$$0.5D1<L1+L2\leqq 2.5D1 \quad (1)$$

$$1.0<D2/D1\leqq 1.4 \text{ if } 0<L1/R1<0.5 \quad (2)$$

$$1.0<D2/D1<1.8-0.8L1/R1 \text{ if } 0.5\leqq L1/R1<1 \quad (3)$$

Expression (1)

In order to form the gap IS between the billet in the piercing and rolling process and plug 1, the total length of the tip end portion 10 and the taper portion 11 (L1+L2) must be a specified length. If L1+L2 is too small, the gap IS is not formed because the billet contacts with the middle portion 12 before the hole H0 formed in the billet expands to form the gap IS between the billet and the taper portion 11. As can be understood from Expression (1), if L1+L2 is larger than 0.5D1, the gap IS can be formed between the billet and the taper portion 11. Meanwhile, if the total length of the tip end portion 10 and the taper portion 11 is too large, the taper portion 11 buckles during piercing and rolling. In order to prevent such buckling, the length L1+L2 is not more than 2.5D1 as can be seen from Expression 1.

Note that if the length L1+L2 is large, the tip end portion 10 and the taper portion 11 are less likely to suffer from erosion. This is because the heat capacity of the tip end portion 10 and the taper portion 11 becomes larger. Therefore, a certain length is preferably secured for L1+L2. The length L1+L2 is preferably in the range from 0.9D1 to 2.5D1 (0.9D1≦L1+L2≦2.5D1).

Expressions (2) and (3)

In order to reduce the re-grinding allowance, the taper portion 11 preferably has a tapered shape. In order to form the tapered shape, it is only necessary to increase the diameter $D_{H0}$ of the hole H0 formed in the billet by the tip end portion 10.

Figure 1B:
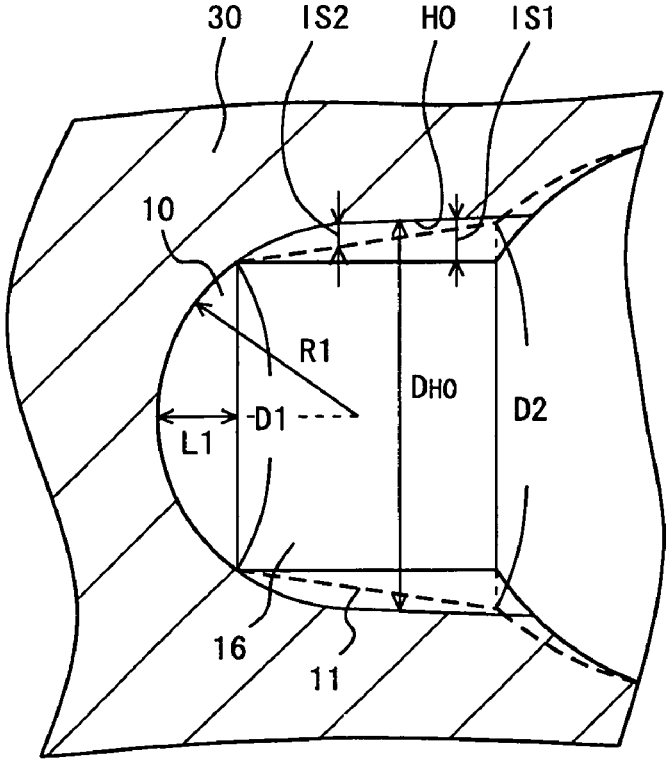
FIG. 1B is a view of another example different from FIG. 1A for use in illustrating the effect of the surface shape of the tip end portion of a plug upon the gap formed between a billet in the piercing and rolling process.
Figure 2:
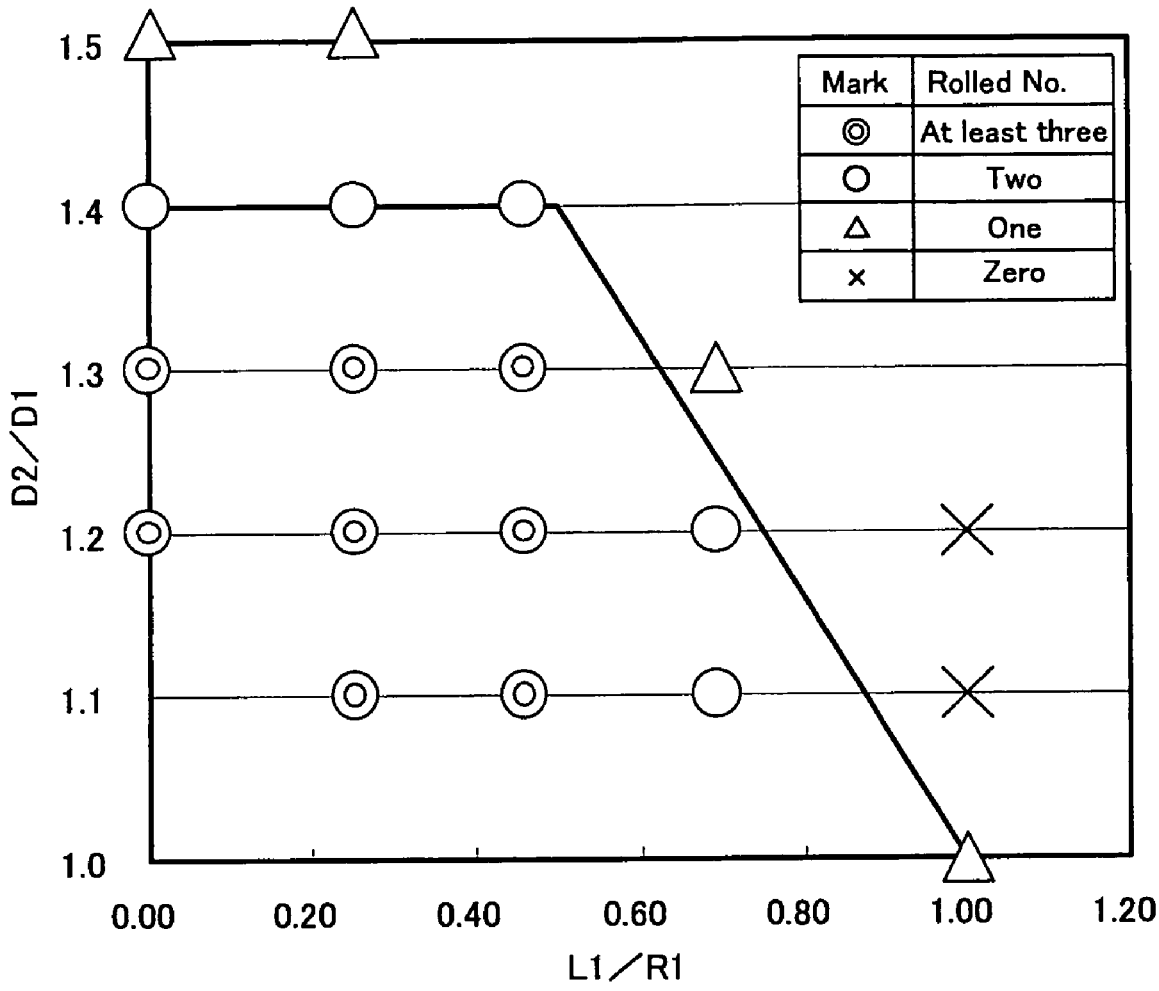
FIG. 2 is a graph showing the relation between the surface shape of the tip end portion of a plug, and the shape of the taper portion of the plug, and the number of billets pierced and rolled before the plug was eroded.

As shown in FIGS. 1A, 1B, and 2, the diameter $D_{H0}$ of the hole H0 formed in the billet by the tip end portion 10 depends on the degree of the curve of the spherical surface 101 of the tip end portion 10. More specifically, if 0.5≦L1/R1<1.0, the diameter $D_{H0}$ increases as L1/R1 decreases or the curve of the spherical surface 101 becomes gentler. In this case, if the outer diameter D1 of the taper portion 11 on the front end side and the outer diameter D2 on the back end side satisfy Expression (3), the gap IS can be formed between the taper portion 11 and the billet. This prevents erosion and the re-grinding allowance can be reduced.

Meanwhile, when the curve of the spherical surface 101 is even gentler and 0<L1/R1<0.5 holds, the diameter $D_{H0}$ of the hole H0 in the billet no longer changes much if the L1/R1 is reduced. In this case, if the outer diameters D1 and D2 satisfy Expression (2), the taper portion 11 does not contact with the billet.

Figure 5:
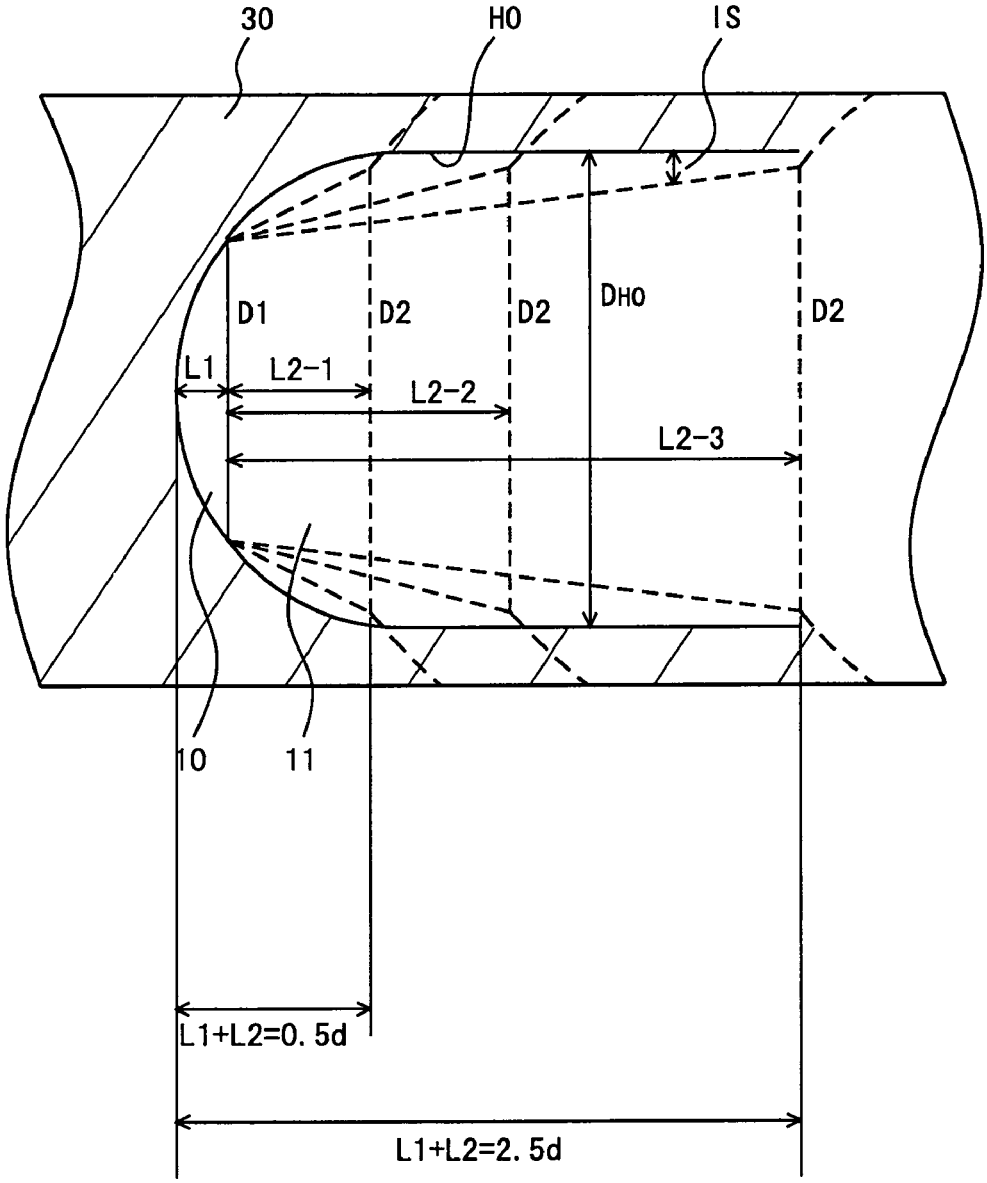
FIG. 5 is a view for use in illustrating the shape of the gap between a billet in the piercing and rolling process.

In Expressions (2) and (3), D1 and D2 are used as factors for determining the tapered shape of the taper portion 11 for the following reasons. As shown in FIG. 5, the diameter $D_{H0}$ of the hole H0 formed in the billet 30 is abruptly expanded immediately after the passage of the tip end portion 10 but fixed thereafter. The force acting to expand the hole H0 is large immediately after the passage of the tip end 10, but then the hole H0 is subjected to force acting to reduce the diameter from the inclined rolls, and it is therefore believed that the diameter $D_{H0}$ substantially converges to a fixed value. In this way, as long as L1+L2 satisfies Expression (1), the diameter $D_{H0}$ is substantially fixed. Therefore, if the length L2 changes in the range from L2-1 to L2-3 in FIG. 5, D2/D1 can be determined independently of the changes in the length L2. Therefore, if Expression (2) or (3) using D2/D1 is satisfied, the shape of the taper portion 11 corresponding to the diameter $D_{H0}$ of the hole H0 formed based on the shape (L1/R1) of the tip end portion 10 can be determined.

As in the foregoing, the curve of the spherical surface of the tip end portion 10 of the plug 1 is formed to be gentler than that of the semi-spherical surface, so that the diameter $D_{H0}$ of the hole H0 can be larger and the gap IS may be secured despite the tapered shape. Therefore, if Expression (1) is satisfied and Expression (2) or (3) is satisfied, the billet in the piercing and rolling process does not contact with the taper portion 11 despite the tapered shape of the taper portion 11, and the erosion can be reduced. Furthermore, the tapered shape of the taper portion 11 can reduce the re-grinding allowance even if erosion occurs, and the plug 1 can be reused after re-grinding.

Figure 6:
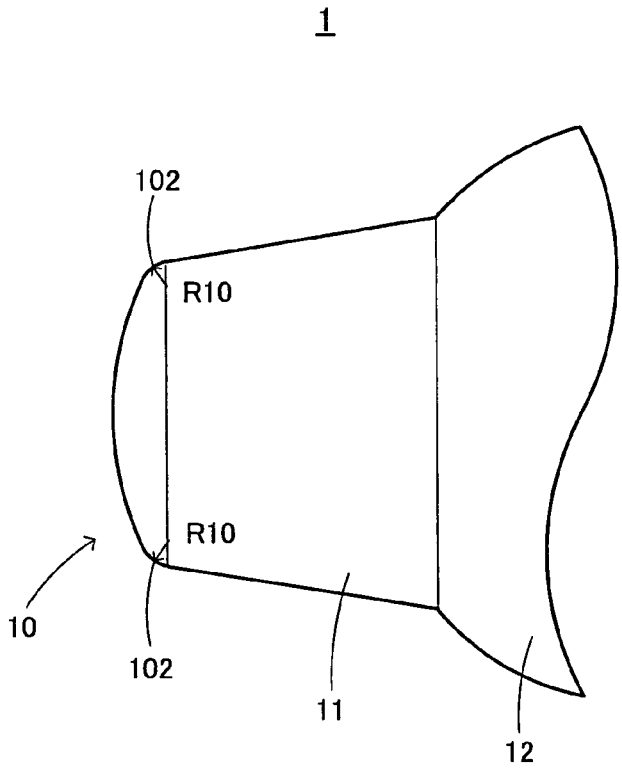
FIG. 6 is a side view of another plug having a different shape from the plug in FIG. 3.

As shown in FIG. 6, a corner radius R10 may be provided at the portion 102 of the tip end portion 10 adjacent to the taper portion 11. The billet in the piercing and rolling process contacts with the plug 1 at the top of the spherical surface 101 of the tip end portion 10 and moves away from the plug 1 around the adjacent portion 102. When the billet moves away from the plug 1, the plastic flow of the billet increases, and therefore the adjacent portion 102 may be eroded if the surface of the adjacent portion 102 is not smooth. The corner radius R10 is provided at the adjacent portion 102 to smooth the surface of the adjacent portion 102, so that the erosion can be further reduced.

Figure 7:
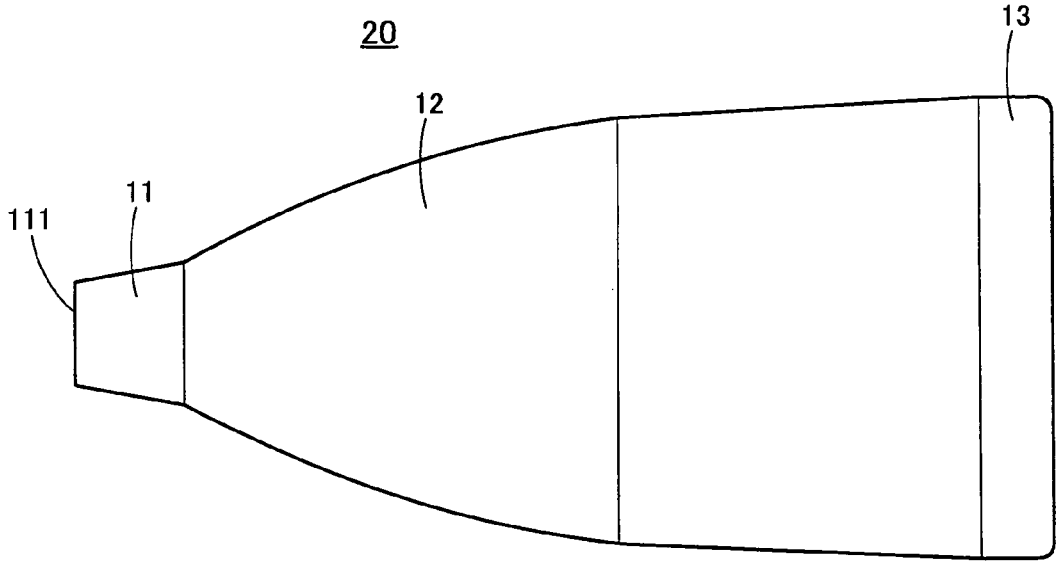
FIG. 7 is a side view of another plug having a different shape from the plugs shown in FIGS. 3 and 6.

As shown in FIG. 7, the same effect as the plug 1 is provided to a plug 20 including a taper portion 11, a middle portion 12, and a relief portion 13 without having the tip end portion 10 of the plug 1. In this case, the tip end side surface 111 of the taper portion 11 forms a plane parallel to the cross section. Force acting to expand the hole H0 formed in the billet by the tip end side surface 111 is larger than that in the case of the spherical surface, and therefore the diameter $D_{H0}$ of the hole H0 formed by the tip end side surface 111 is larger than that in the case of the tip end portion 10. Therefore, if the following Expressions (4) and (2) are satisfied, and the taper portion 11 is formed, the gap IS can be formed between the taper portion 11 and the billet, so that the taper portion 11 does not contact with the billet.

$$1.0 < D2/D1 \leqq 1.4 \quad (2)$$

$$0.5D1 < L2 \leqq 2.5D1 \quad (4)$$

Figure 8:
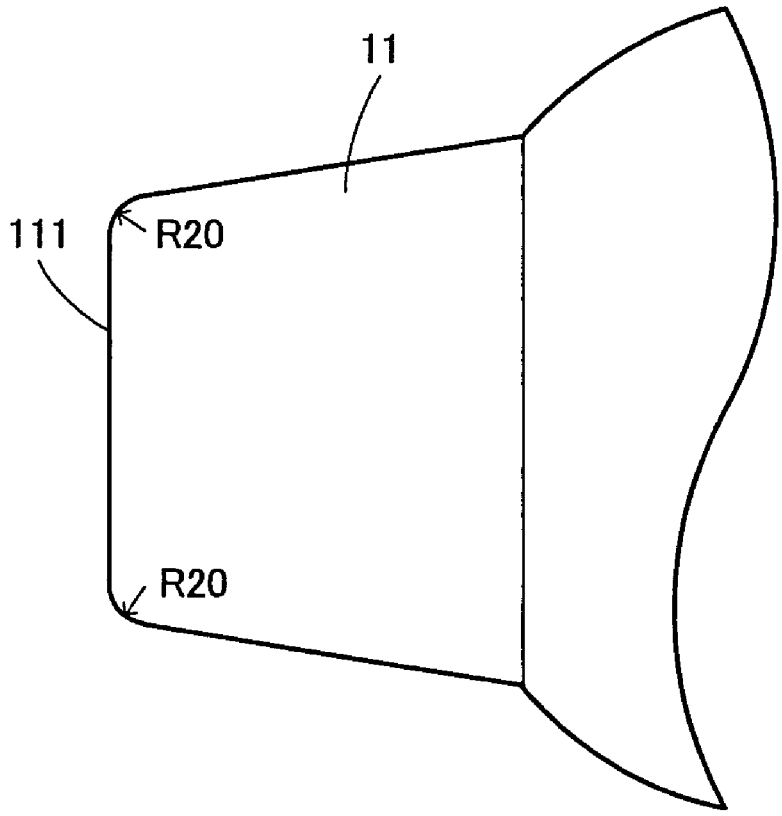
FIG. 8 is a side view of another plug having a different shape from the plugs shown in FIGS. 3, 6 and 7.

As shown in FIG. 8, a corner radius R20 may be provided at the tip end side surface 111. In this case, the erosion can be further reduced for the same reason applied to the case shown in FIG. 6.

The material of the plugs 1 and 20 according to the embodiment is the same as that of a well known plug.

FIRST EXAMPLE

Figure 9:
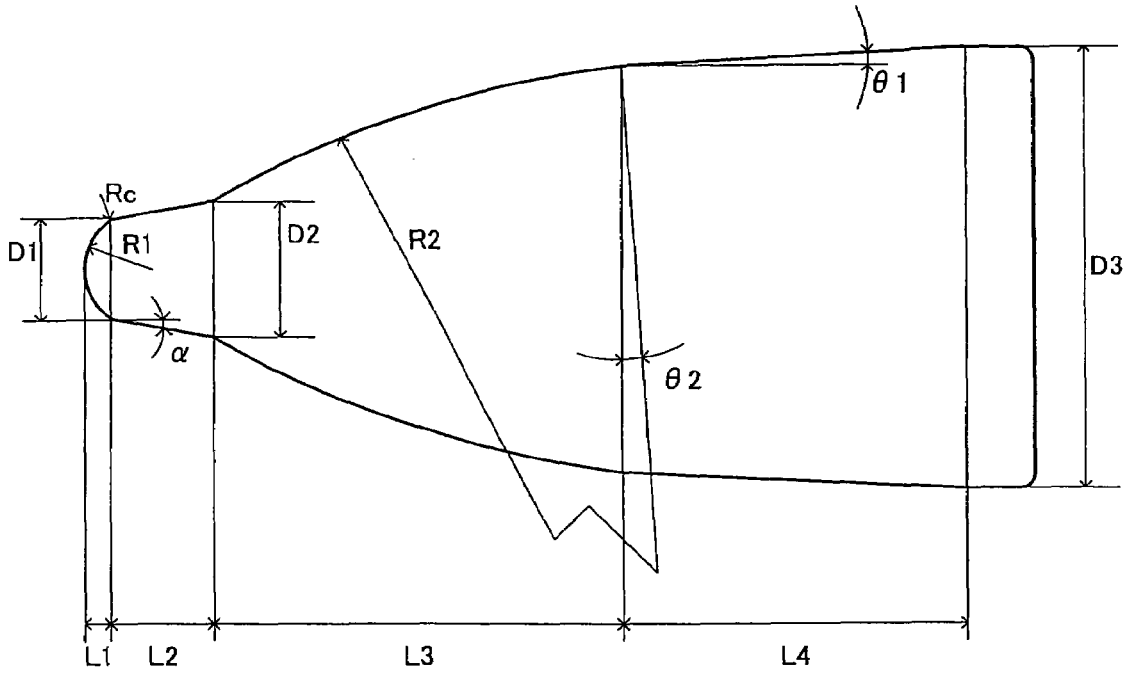
FIG. 9 is a side view of a plug used according to an embodiment.
Figure 10:
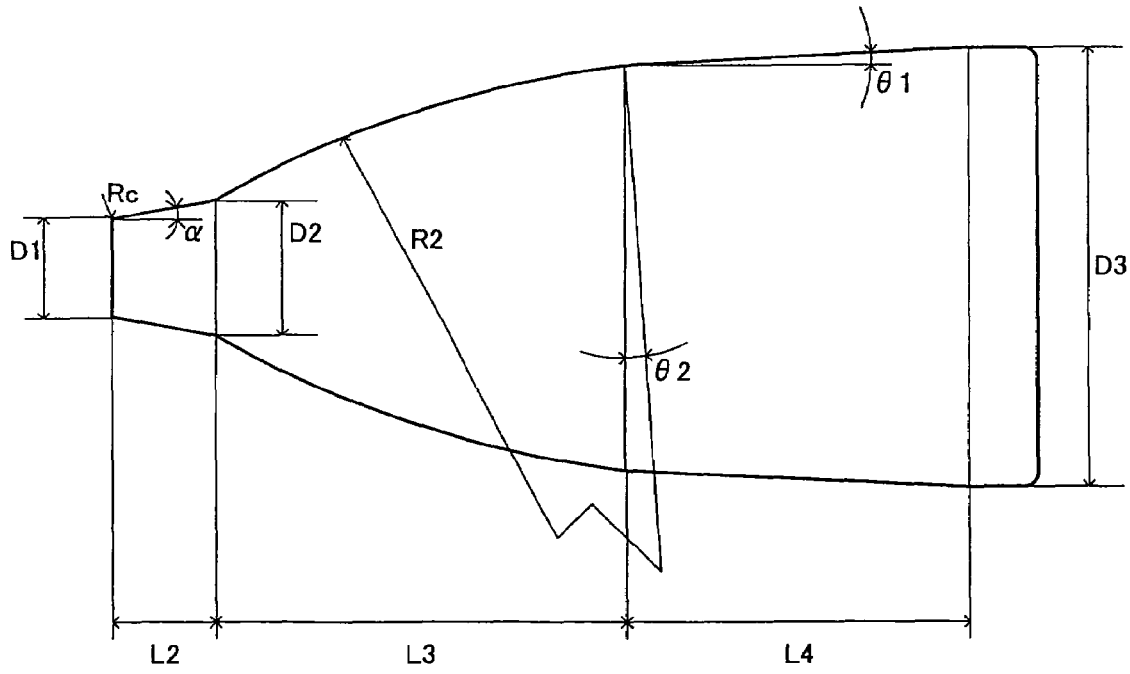
FIG. 10 is a side view of a plug having a different shape from the plug in FIG. 9 used according to the embodiment.
Figure 11:
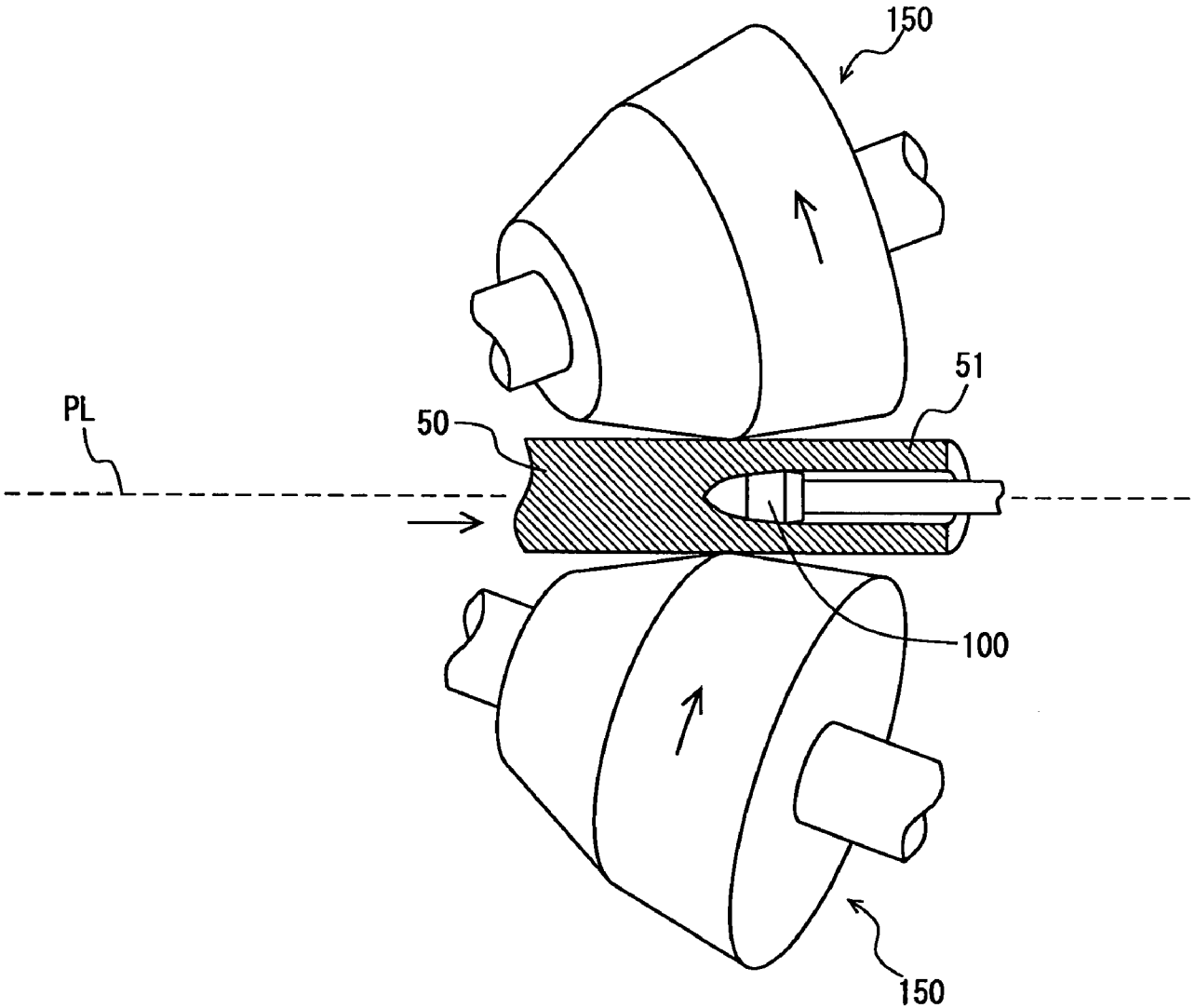
FIG. 11 PRIOR ART
FIG. 11 is a view of a conventional piercing mill and a plug therefor.
Figure 12:
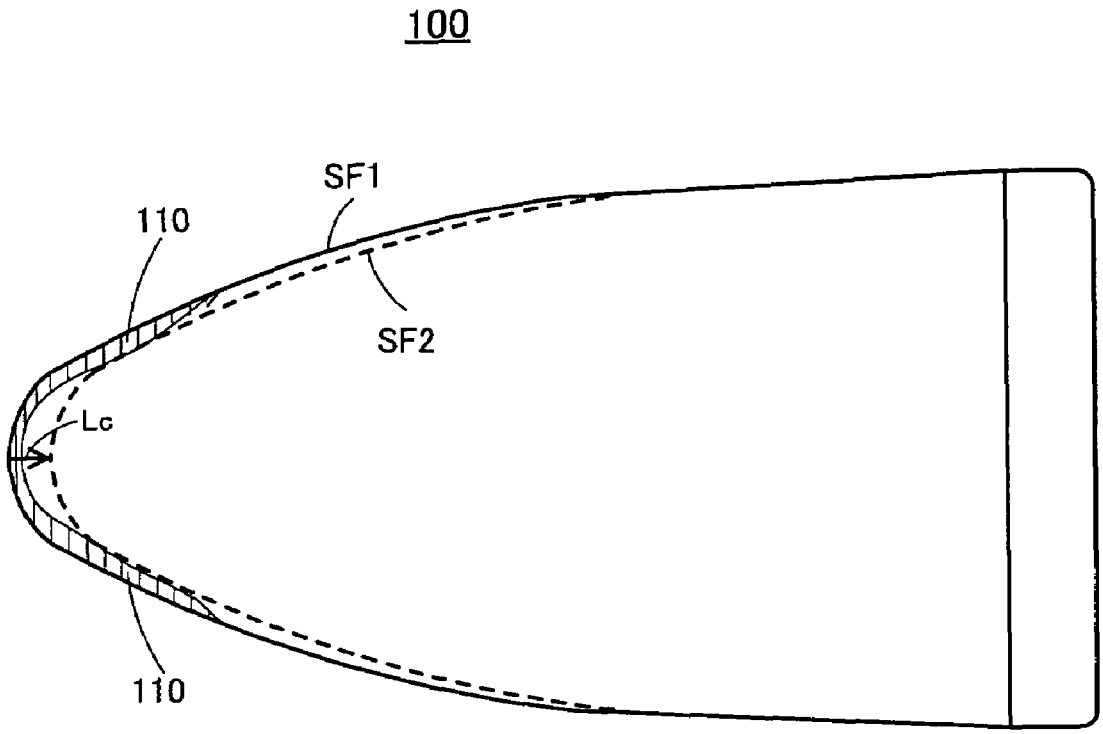
FIG.12 PRIOR ART
FIG. 12 is a view for use in illustrating a conventional method of re-cutting a plug.
Figure 13:
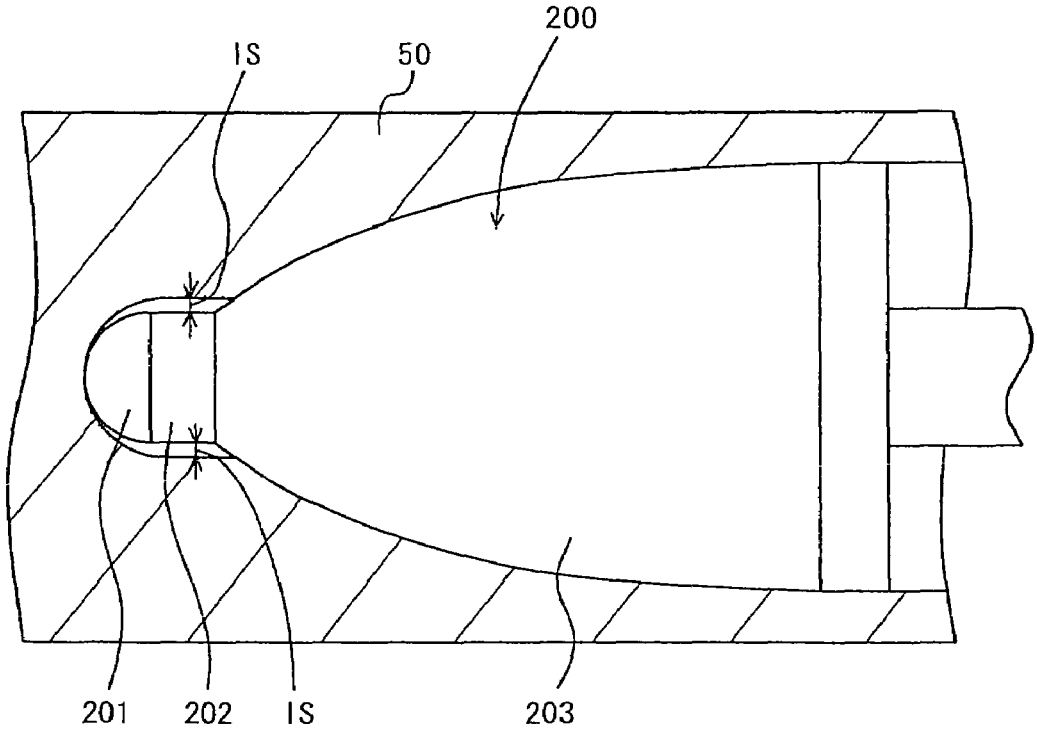
FIG. 13 PRIOR ART
FIG. 13 is a view for use in illustrating how a billet is pierced and rolled using a conventional plug having a shape different from the plugs shown in FIGS. 11 and 12.
Figure 14:
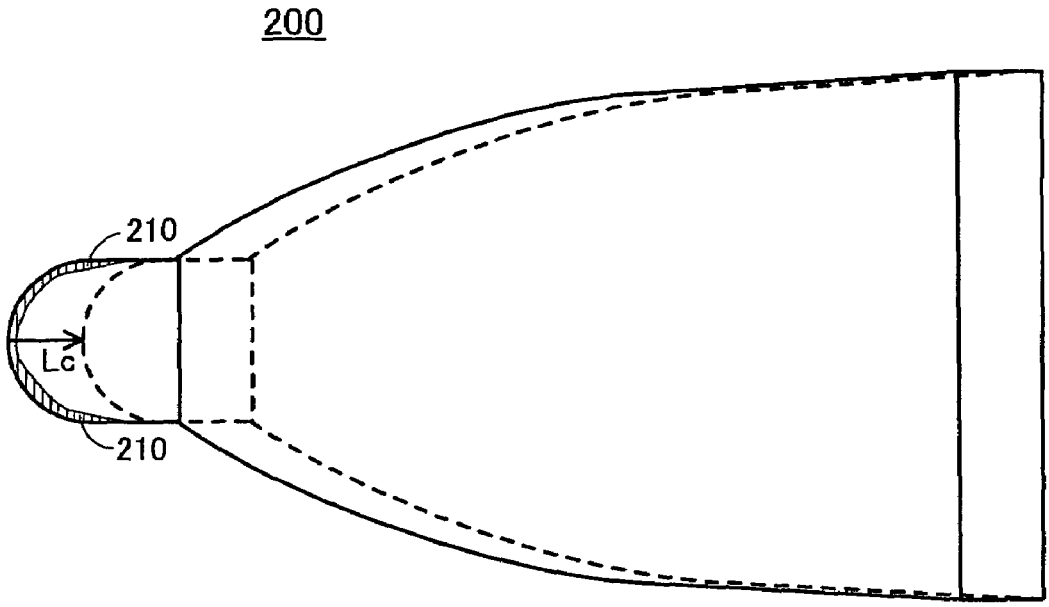
FIG.14 PRIOR ART
FIG. 14 is a view for use in illustrating how the plug in FIG. 13 is re-grinded.

Using plugs having shapes in FIGS. 9 and 10 and Table 1, billets were pierced and rolled, and the plugs were examined for their useful lives.

TABLE 1

| | | item | | | | | | | | | | |
|---|---|---|---|---|---|---|---|---|---|---|---|---|
| | No. | 1<br>L1/R1 | 2<br>D2/D1 | 3<br>1.8 − 0.8 × L1/R1 | 4<br>0.5 D1 | 5<br>2.5 D1 | 6<br>L1 + L2 | 7<br>α degree | 8<br>D3 mm | 9<br>L1 mm | 10<br>L2 mm | 11<br>L3 mm |
| Comp. Example | 1 | 1.00 | 1.0 | 1.00 | 8.0 | 40.0 | 15.0 | 0.0 | 60.0 | 8.00 | 7.00 | 60.0 |
| Comp. Example | 2 | 1.00 | 1.1 | 1.00 | 8.0 | 40.0 | 15.0 | 6.5 | 60.0 | 8.00 | 7.00 | 60.0 |
| Comp. Example | 3 | 1.00 | 1.2 | 1.00 | 8.0 | 40.0 | 15.0 | 12.9 | 60.0 | 8.00 | 7.00 | 60.0 |
| Inv. Example | 4 | 0.70 | 1.1 | 1.24 | 8.0 | 40.0 | 15.0 | 5.0 | 60.0 | 5.84 | 9.16 | 60.0 |
| Inv. Example | 5 | 0.70 | 1.2 | 1.24 | 8.0 | 40.0 | 15.0 | 9.9 | 60.0 | 5.84 | 9.16 | 60.0 |
| Comp. Example | 6 | 0.70 | 1.3 | 1.24 | 8.0 | 40.0 | 15.0 | 14.7 | 60.0 | 5.84 | 9.16 | 60.0 |
| Inv. Example | 7 | 0.46 | 1.1 | — | 8.0 | 40.0 | 15.0 | 4.3 | 60.0 | 4.38 | 10.62 | 60.0 |
| Inv. Example | 8 | 0.46 | 1.2 | — | 8.0 | 40.0 | 15.0 | 8.6 | 60.0 | 4.38 | 10.62 | 60.0 |
| Inv. Example | 9 | 0.46 | 1.3 | — | 8.0 | 40.0 | 15.0 | 12.7 | 60.0 | 4.38 | 10.62 | 60.0 |

TABLE 1-continued

| | | | | | | | | | | | | |
|---|---|---|---|---|---|---|---|---|---|---|---|---|
| Inv. Example | 10 | 0.46 | 1.4 | — | 8.0 | 40.0 | 15.0 | 16.8 | 60.0 | 4.38 | 10.62 | 60.0 |
| Inv. Example | 11 | 0.25 | 1.1 | — | 8.0 | 40.0 | 15.0 | 3.8 | 60.0 | 3.06 | 11.94 | 60.0 |
| Inv. Example | 12 | 0.25 | 1.2 | — | 8.0 | 40.0 | 15.0 | 7.6 | 60.0 | 3.06 | 11.94 | 60.0 |
| Inv. Example | 13 | 0.25 | 1.3 | — | 8.0 | 40.0 | 15.0 | 11.4 | 60.0 | 3.06 | 11.94 | 60.0 |
| Inv. Example | 14 | 0.25 | 1.4 | — | 8.0 | 40.0 | 15.0 | 15.0 | 60.0 | 3.06 | 11.94 | 60.0 |
| Comp. Example | 15 | 0.25 | 1.5 | — | 8.0 | 40.0 | 15.0 | 18.5 | 60.0 | 3.06 | 11.94 | 60.0 |
| Inv. Example | 16 | 0.00 | 1.2 | — | 8.0 | 40.0 | — | 6.1 | 60.0 | — | 15.00 | 60.0 |
| Inv. Example | 17 | 0.00 | 1.3 | — | 8.0 | 40.0 | — | 9.1 | 60.0 | — | 15.00 | 60.0 |
| Inv. Example | 18 | 0.00 | 1.4 | — | 8.0 | 40.0 | — | 12.0 | 60.0 | — | 15.00 | 60.0 |
| Comp. Example | 19 | 0.00 | 1.5 | — | 8.0 | 40.0 | — | 14.9 | 60.0 | — | 15.00 | 60.0 |
| Inv. Example | 20 | 0.46 | 1.1 | — | 8.0 | 40.0 | 15.0 | 4.3 | 60.0 | 4.38 | 10.62 | 60.0 |
| Inv. Example | 21 | 0.46 | 1.2 | — | 8.0 | 40.0 | 15.0 | 8.6 | 60.0 | 4.38 | 10.62 | 60.0 |
| Inv. Example | 22 | 0.46 | 1.3 | — | 8.0 | 40.0 | 15.0 | 12.7 | 60.0 | 4.38 | 10.62 | 60.0 |
| Inv. Example | 23 | 0.46 | 1.2 | — | 8.0 | 40.0 | 8.5 | 21.2 | 60.0 | 4.38 | 4.12 | 66.5 |
| Inv. Example | 24 | 0.46 | 1.2 | — | 8.0 | 40.0 | 32.0 | 3.3 | 60.0 | 4.38 | 27.62 | 43.0 |

| | | item | | | | | | | | | |
|---|---|---|---|---|---|---|---|---|---|---|---|
| | No. | 12 L4 mm | 13 θ1 degree | 14 θ2 degree | 15 R1 mm | 16 Rc mm | 17 R2 mm | 18 D1 mm | 19 D2 mm | 20 rolled No. | 21 evaluation |
| Comp. Example | 1 | 45 | 4.00 | 6.00 | 8.0 | 1.0 | 158.49 | 16.0 | 16.0 | 1 | Δ |
| Comp. Example | 2 | 45 | 4.00 | 6.00 | 8.0 | 1.0 | 168.02 | 16.0 | 17.6 | 0 | X |
| Comp. Example | 3 | 45 | 4.00 | 6.00 | 8.0 | 1.0 | 179.00 | 16.0 | 19.2 | 0 | X |
| Inv. Example | 4 | 45 | 4.00 | 6.00 | 8.4 | 1.0 | 168.02 | 16.0 | 17.6 | 2 | ○ |
| Inv. Example | 5 | 45 | 4.00 | 6.00 | 8.4 | 1.0 | 179.00 | 16.0 | 19.2 | 2 | ○ |
| Comp. Example | 6 | 45 | 4.00 | 6.00 | 8.4 | 1.0 | 191.78 | 16.0 | 20.8 | 1 | Δ |
| Inv. Example | 7 | 45 | 4.00 | 6.00 | 9.5 | 1.0 | 168.02 | 16.0 | 17.6 | ≧3 | ◎ |
| Inv. Example | 8 | 45 | 4.00 | 6.00 | 9.5 | 1.0 | 179.00 | 16.0 | 19.2 | ≧3 | ◎ |
| Inv. Example | 9 | 45 | 4.00 | 6.00 | 9.5 | 1.0 | 191.78 | 16.0 | 20.8 | ≧3 | ◎ |
| Inv. Example | 10 | 45 | 4.00 | 6.00 | 9.5 | 1.0 | 206.81 | 16.0 | 22.4 | 2 | ○ |
| Inv. Example | 11 | 45 | 4.00 | 6.00 | 12.0 | 1.0 | 168.02 | 16.0 | 17.6 | ≧3 | ◎ |
| Inv. Example | 12 | 45 | 4.00 | 6.00 | 12.0 | 1.0 | 179.00 | 16.0 | 19.2 | ≧3 | ◎ |
| Inv. Example | 13 | 45 | 4.00 | 6.00 | 12.0 | 1.0 | 191.78 | 16.0 | 20.8 | ≧3 | ◎ |
| Inv. Example | 14 | 45 | 4.00 | 6.00 | 12.0 | 1.0 | 206.81 | 16.0 | 22.4 | 2 | ○ |
| Comp. Example | 15 | 45 | 4.00 | 6.00 | 12.0 | 1.0 | 224.74 | 16.0 | 24.0 | 1 | Δ |
| Inv. Example | 16 | 45 | 4.00 | 6.00 | — | 1.0 | 179.00 | 16.0 | 19.2 | ≧3 | ◎ |
| Inv. Example | 17 | 45 | 4.00 | 6.00 | — | 1.0 | 191.78 | 16.0 | 20.8 | ≧3 | ◎ |
| Inv. Example | 18 | 45 | 4.00 | 6.00 | — | 1.0 | 206.81 | 16.0 | 22.4 | 2 | ○ |
| Comp. Example | 19 | 45 | 4.00 | 6.00 | — | 1.0 | 224.74 | 16.0 | 24.0 | 1 | Δ |
| Inv. Example | 20 | 45 | 4.00 | 6.00 | 9.5 | — | 168.02 | 16.0 | 17.6 | ≧3 | ◎ |
| Inv. Example | 21 | 45 | 4.00 | 6.00 | 9.5 | — | 179.00 | 16.0 | 19.2 | ≧3 | ◎ |

TABLE 1-continued

| | | | | | | | | | | | |
|---|---|---|---|---|---|---|---|---|---|---|---|
| Inv. Example | 22 | 45 | 4.00 | 6.00 | 9.5 | — | 191.78 | 16.0 | 20.8 | ≧3 | ◎ |
| Inv. Example | 23 | 45 | 4.00 | 6.00 | 9.5 | 1.0 | 231.20 | 16.0 | 19.2 | ≧3 | ◎ |
| Inv. Example | 24 | 45 | 4.00 | 6.00 | 9.5 | 1.0 | 84.75 | 16.0 | 19.2 | ≧3 | ◎ |

Inv. Example: Inventive Example,
Comp. Example: Comparative Example

The plugs designated as test numbers 1 to 15 and 20 to 24 in Table 1 had the shape shown in FIG. 9 and those designated as test numbers 16 to 19 had the shape shown in FIG. 10. The characters (concerning the size) in items 7 to 19 in Table 1 correspond to the characters in FIGS. 9 and 10. The material of the plugs was 1.5% Cr-3% Ni steel (SNCM616 by JIS (Japanese Industrial Standard)).

A billet pierced and rolled was a round billet of SUS 304 steel having a diameter of 70 mm and an axial length of 400 mm. The billet heated to 1200° C. was pierced and rolled by a piercing mill having each of the plugs designated by the test numbers, and formed into a hollow pipe or tube having an outer diameter of 76 mm and a thickness of 6 mm. The conditions for the piercing mill are given in Table 2.

TABLE 2

| piercing and rolling conditions | | | |
|---|---|---|---|
| inclined roll | gorge size | 410 | mm |
| | revolution number | 60 | rpm |
| | inclined angle | 10 | degree |
| | opening degree | 60.7 | mm |
| | plug lead | 40.5 | mm |

The tests were conducted by the following method. One or more billets were pierced and rolled until a plug designated by each test number was eroded. More specifically, every time one billet was pierced and rolled into a hollow pipe or tube, the plug surface was observed and whether erosion occurred or not was visually inspected. When it was determined that there was erosion, the piercing and rolling using the plug ended, and the number of billets (rolled number) that had been pierced and rolled before the occurrence of the erosion was counted. For example, when the occurrence of erosion was determined after piercing and rolling three billets, the rolled number was indicated as two ("○" in Table 1). When there was no erosion after piercing and rolling three billets, the rolled number was indicated as three or more ("◎" in Table 1). When the rolled number was two or more, it was determined that the erosion was reduced. When the rolled number was one ("Δ" in Table 1) or zero ("x" in Table 1), it was determined that the erosion was not reduced.

The result of examination is given in Table 1. The values in item 6 for test numbers 4 and 5 in Table 1 satisfy Expression (1), and the values in items 2 and 3 satisfy Expression (3). Therefore, the rolled number was two or more though the taper portions had taper half angles α of 5.0 degrees and 9.9 degrees, and the erosion was reduced. It is considered that this was because the curve of the spherical surface of the tip end portion was gentler than that of the semi-spherical surface, the diameter $D_{H0}$ of the hole H0 formed in the billet was larger and the gap IS was formed between the taper portion and the billet. The curve of the spherical surface of the tip end portion was gentler and its surface area was smaller than that of the semi-spherical surface, so that incoming heat from the billet was restricted, and erosion did not occur at the tip end portion.

The values in item 6 for the plugs designated as test numbers 7 to 14 and 20 to 24 satisfied Expression (1). The values in item 1 (L1/R1) were less than 0.5, and the values in item 2 satisfied Expression (2). Therefore, the rolled number was two or more though the taper portions each had a taper half angle α in the range from 3.3 degrees to 21.2 degrees, and the erosion was reduced.

The plugs designated as test numbers 16 to 18 satisfied Expressions (4) and (2) and therefore the rolled number was two or more though the taper portions each had a taper half angle α in the range from 6.1 degrees to 12.0 degrees.

On the other hand, with the plug designated as test number 1 whose radius of curvature R1 equaled the length L1, the rolled number was one. When the plug was observed, there was erosion at the plug tip end portion. It is considered that the tip end portion had a semi-spherical surface and a large surface area, and therefore the quantity of incoming heat was greater, which caused the erosion. With the plugs designated as test numbers 2 and 3 whose radius of curvature R1 equaled the length L1 similarly to the plug designated as test number 1, the rolled number was zero. When the plug was observed after the test, there was erosion at the plug tip end portions and the taper portions. It is considered that since the tip end portion had a semi-spherical shape, the gap IS could not be formed between the taper portion and the billet, and the taper portion contacted with the billet.

The plug designated as test number 6 did not satisfy Expression (3) as the value in item 2 was larger than the value in item 3. Therefore, the rolled number was one. When the plug was observed after the test, there was erosion at the tip end portion and the taper portion. It is considered that since Expression (3) was not satisfied, the taper portion and the billet contacted with each other and the quantity of incoming heat to the tip end portion increased.

The plugs designated as test numbers 15 and 19 did not satisfy Expression (2) as the values in item 2 were larger than 1.4. Therefore, the rolled number was one. When the plug was observed after the test, there was erosion at the tip end and the taper portion. It is considered that since Expression (2) was not satisfied, the taper portion contacted with the billet and the quantity of incoming heat to the tip end portion increased.

EXAMPLE 2

The plugs designated as test numbers 20 to 22 did not have a corner radius Rc, but the other shape and size were the same as those of the plugs designated as test numbers 7 to 9. More specifically, the plug designated as test number 20 had the same size as that of the plug designated as test number 7 except for the corner radius Rc. Similarly, the plugs designated as test numbers 21 and 22 had the same sizes as those of the plugs designated as test numbers 8 and 9, respectively, both except for the corner radius Rc.

As a result of examination in Example 1, with the plugs designated as test numbers 20 to 22, the roll number was three or more similarly to the plugs designated as test numbers 7 to 9. Therefore, in order to examine the effect of the corner radius, the plugs designated as test numbers 7 to 9 and 20 to 22 were further examined for their rolled numbers.

As a result of examination, the plugs designated as test numbers 20 to 22 having no corner radius Rc both had erosion at the portion adjacent to the tip end portion and the taper portion after piercing and rolling the fourth billet. In short, with the plugs designated as test numbers 20 to 22, the rolled number was three. Meanwhile, the plugs designated as test numbers 7 to 9 each having a corner radius Rc had erosion after piercing. and rolling the fifth billet, in other words, the rolled number was four. It is considered that with the plugs designated as test numbers 7 to 9 each having a corner radius, the erosion was more reduced.

EXAMPLE 3

The relation between the spherical surface shapes of the tip end portions and the occurrence of erosion was examined. More specifically, the plugs designated as test numbers 7 and 11, 8 and 12, and 9 and 13 having almost the same taper half angles α for their taper portions and different values for L1/R1 were examined for the rolled numbers. As a result, for each of the plugs, the rolled number was four. Therefore, the plugs were re-grinded in the axial direction until the eroded portions were removed, and the plugs were examined for their re-grinding allowances. More specifically, the plugs were each re-grinded by 0.5 mm in the axial direction and it was determined by visual inspection whether there was still an eroded portion remaining after the re-grinding. When the eroded portion remained, the plug was re-grinded for another 0.5 mm. The result of examination is given in Table 3.

TABLE 3

| Test No. | L1/R1 | re-cutting allowance (mm) |
|---|---|---|
| 7 | 0.46 | 11.0 |
| 11 | 0.25 | 9.5 |
| 8 | 0.46 | 10.0 |
| 12 | 0.25 | 8.0 |
| 9 | 0.46 | 7.5 |
| 13 | 0.25 | 7.0 |

Referring to Table 3, between the plugs designated as test numbers 7 and 11 having about the same half angles α, the plug designated as test number 7 whose L1/R1 was larger had a larger re-grinding allowance than the plug designated as test number 11 whose L1/R1 was smaller. Similarly, the plug designated as test number 8 had a larger re-grinding allowance than that of the plug designated as test number 12, and the plug designated as test number 9 had a larger re-grinding allowance than that of the plug designated as test number 13. Consequently, the plugs designated as test numbers 7 to 9 having larger values for L1/R1 had more erosion than the plugs designated as test numbers 11 to 13 having smaller values for L1/R1 and gentler curves at the spherical surfaces.

The test numbers 11 to 13 had gentler curves at the spherical surfaces of the tip end portions than those of the test numbers 7 to 9. Therefore, it is considered that the surface areas of the tip end portions of the test numbers 11 to 13 were smaller than those of the test numbers 7 to 9, and incoming heat from the billets were more restricted, so that the erosion was reduced.

The embodiments of the present invention have been shown and described simply by way of illustrating the invention. Therefore, the invention is not limited to the embodiments described above and various modifications may be made therein without departing from the scope of the invention.

What is claimed is:

1. A plug for use in a piercing mill, comprising a tip end portion, a taper portion, and a middle portion sequentially in the direction from the front end to the back end of said plug, wherein the surface of said tip end portion has a convex spherical surface in the axial direction of said plug, its radius of curvature is R1, the length of said tip end portion is L1 that is smaller than said R1, the surface of said taper portion is formed continuously with the surface of said tip end portion, the outer diameter of said taper portion on the front end side is D1, the outer diameter of said taper portion on the back end side is D2 that is larger than D1, the length of said taper portion is L2, the surface of said middle portion is formed continuously with the surface of said taper portion, the outer diameter of said middle portion gradually increases in the direction from the front end to the back end of said plug, and said plug satisfies Expression (1), Expression (2) if 0<L1/R1<0.5, and Expression (3) if 0.5≦L1/R1<1:

$$0.5D1<L1+L2\leqq 2.5D1 \quad (1)$$

$$1.0<D2/D1\leqq 1.4 \quad (2)$$

$$1.0<D2/D1<1.8-0.8L1/R1 \quad (3).$$

2. The plug according to claim 1, wherein a portion of said tip end portion adjacent to said taper portion has a corner radius.

3. A plug for use in a piercing mill, comprising a taper portion, and a middle portion sequentially in the direction from the front end to the back end of said plug, wherein said taper portion on the front end side forms a plane parallel to a cross section of said plug, the outer diameter of said taper portion on the front end side is D1, the outer diameter of said taper portion on the back end side is D2 that is larger than D1, the length of said taper portion is L2, the surface of said middle portion is continuously formed with the surface of said taper portion, the outer diameter of said middle portion gradually increases in the direction from the front end to the back end of said plug, and said plug satisfies Expressions (2) and (4):

$$1.0<D2/D1\leqq 1.4 \quad (2)$$

$$0.5D1<L2\leqq 2.5D1 \quad (4).$$

* * * * *